US008253517B2

(12) United States Patent
Weber

(10) Patent No.: US 8,253,517 B2
(45) Date of Patent: Aug. 28, 2012

(54) FULL-PROTECTION CIRCUIT BREAKER

(75) Inventor: Ralph Weber, Heidelberg (DE)

(73) Assignee: ABB AG, Mannheim (DE)

( * ) Notice: Subject to any disclaimer, the term of this patent is extended or adjusted under 35 U.S.C. 154(b) by 593 days.

(21) Appl. No.: 12/414,988

(22) Filed: Mar. 31, 2009

(65) Prior Publication Data

US 2009/0242372 A1 Oct. 1, 2009

(30) Foreign Application Priority Data

Apr. 1, 2008 (DE) ..... 10 2008 016 575

(51) Int. Cl.
*H01H 9/02* (2006.01)
*H01H 13/04* (2006.01)

(52) U.S. Cl. ..... 335/202; 335/169; 200/400

(58) Field of Classification Search ..... 335/202, 335/2, 167–172; 200/400
See application file for complete search history.

(56) References Cited

U.S. PATENT DOCUMENTS 4,167,716 A * 9/1979 Horn ..... 335/14
6,545,574 B1 * 4/2003 Seymour et al. ..... 335/18
2004/0000469 A1 * 1/2004 Gibson et al. ..... 200/400
2007/0289852 A1 * 12/2007 McCoy ..... 200/43.01
2009/0102584 A1 * 4/2009 Zende et al. ..... 335/10

FOREIGN PATENT DOCUMENTS

DE 44 13 418 A1 10/1995

* cited by examiner

*Primary Examiner* — Bernard Rojas
(74) *Attorney, Agent, or Firm* — Buchanan Ingersoll & Rooney PC

(57) ABSTRACT

A full-protection circuit breaker has a line-protection circuit breaker and a residual-current-operated component which can be fitted thereto. A first switching mechanism, located therein, includes a first switching toggle for operation of a first latching mechanism, which is accommodated in the residual-current-operated component. A second switching mechanism, provided in the line-protection circuit breaker, includes a second switching toggle for operation of a second latching mechanism, which is accommodated in the line-protection circuit. The first and the second latching mechanisms are coupled by means of a first coupling element. The first and the second switching toggle are coupled by means of a second coupling element, wherein the second coupling element acts on the first switching toggle with respect to the second switching toggle, pivoting through the predeterminable lead angle in the direction of its connected position.

15 Claims, 7 Drawing Sheets

FULL-PROTECTION CIRCUIT BREAKER

RELATED APPLICATION

This application claims priority under 35 U.S.C. §119 to German Patent Application No. 10 2008 016 575.1 filed in Germany on Apr. 1, 2008, the entire content of which is hereby incorporated by reference in its entirety.

TECHNICAL FIELD

A full-protection circuit breaker is disclosed having a line-protection circuit breaker and a residual-current-operated component which can be fitted thereto.

BACKGROUND INFORMATION

Full-protection circuit breakers such as these with residual-current-operated components and line-protection circuit breakers, which, overall, form a circuit breaker which interrupts a current path to be monitored not only in the event of a short circuit occurring but also in the event of a thermal overcurrent and furthermore also in the event of a fault current occurring, are known in principle. The two devices, the line-protection circuit breaker and the residual-current-operated component, are coupled to one another such that the line-protection circuit breaker is disconnected when the residual-current-operated component trips, but the residual-current-operated component remains in the position ready for tripping when the line-protection circuit breaker responds, provided that the short circuit or overcurrent was not associated with a fault current. Full-protection circuit breakers such as these are therefore used at the same time for protection of the line network to be monitored against short circuits and overloading, for example for prevention of electrical accidents caused by line defects and the like.

DE 44 13 418 A1 discloses a full-protection circuit breaker of this generic type having a line-protection circuit breaker and a residual-current-operated protection part which can be fitted thereto. The release element of the latching mechanism of the residual-current-operated protection part is in this case coupled to the line-protection circuit breaker by means of a coupling element. The coupling element in this case interacts with the tripping lever of the line-protection circuit breaker such that, when the residual-current-operated protection part trips, the coupling element always acts on the tripping lever of the line-protection circuit breaker in the direction of unlatching of the latching point of the latching mechanism of the line-protection circuit breaker. Furthermore, the residual-current-operated protection part and the line-protection circuit breaker are connected to one another via a slide. By interacting with a lever mechanism in the residual-current-operated component, the slide ensures that the residual-current-operated component can be operated even when the line-protection circuit breaker has tripped, for example as a result of an overcurrent.

When, after the residual-current-operated component has responded, the reason for this, that is to say the occurrence of a fault current, has decayed again, then the latching mechanism of the residual-current-operated component remains in its tripped position until it is reset by manual operation of the switching toggle of the residual-current-operated component. Only once the latching mechanism of the residual-current-operated component has been manually reset is the coupling element once again moved to a position in which the action of the tripping lever of the line-protection circuit breaker in the direction of unlatching of the latching point of the latching mechanism of the line-protection circuit breaker cancelled, and the latching point of the latching mechanism of the line-protection circuit breaker can thus be latched again.

Only then can the line-protection circuit breaker be reconnected manually via its switching toggle.

Because of the mechanical lever step-up ratio in the residual-current-operated component, which lever step-up ratio translates the rotary movement of the switching toggle to a linear movement of the coupling element, a certain lead of the switching toggle of the residual-current-operated component is necessarily required. This means that the switching toggle of the residual-current-operated component must first be rotated through a specific angle in the direction of the connected position and only then is the coupling element moved to a position in which it allows relatching of the latching point of the line-protection circuit breaker.

When the line-protection circuit breaker is intended to be reconnected after tripping of the residual-current-operated component and the disconnection of the line-protection circuit breaker which necessarily results from this, the residual-current-operated component must be connected first of all, and only then is it possible to connect the line-protection circuit breaker.

SUMMARY

Exemplary embodiments disclosed herein can allow simplified and joint reconnection of the residual-current-operated component and of the line-protection circuit breaker in a full-protection circuit breaker.

A full-protection circuit breaker is disclosed having a line-protection circuit breaker and a residual-current-operated component which can be fitted thereto, having a first switching mechanism, which is provided in the residual-current-operated component, comprising a first switching toggle for operation of a first latching mechanism, which is accommodated in the residual-current-operated component and has at least one first latching point, and having a second switching mechanism, which is provided in the line-protection circuit breaker, comprising a second switching toggle for operation of a second latching mechanism, which is accommodated in the line-protection circuit breaker and has at least one second latching point, wherein the first and the second latching mechanisms are coupled by means of a first coupling element such that, when the first latching point is unlatched, the second latching point is also unlatched and in the process at least one contact point of the line-protection circuit breaker is opened, and that the second latching mechanism can be reconnected by means of the second switching toggle only when the first switching toggle has been pivoted through a predeterminable lead angle from its disconnected position in the direction of its connected position, wherein the first and the second switching toggle are coupled by means of a second coupling element, wherein the second coupling element acts on the first switching toggle with respect to the second switching toggle, pivoting through the predeterminable lead angle in the direction of its connected position.

In another aspect, a full-protection circuit breaker arrangement is disclosed, comprising a line-protection circuit breaker and a residual-current-operated component. A first switching mechanism is provided in the residual-current-operated component, comprising a first switching toggle for operation of a first latching mechanism, which is accommodated in the residual-current-operated component and has at least one first latching point. A second switching mechanism is provided in the line-protection circuit breaker, comprising a second switching toggle for operation of a second latching mechanism, which is accommodated in the line-protection circuit breaker and has at least one second latching point. The first and the second latching mechanisms are coupled using a first coupling element. The first and the second switching toggle are coupled using a second coupling element. The second coupling element acts on the first switching toggle with respect to the second switching toggle, pivoting through the predeterminable lead angle in the direction of its connected position.

Yet, in another aspect, a method of providing a full circuit-breaker protection based on a line-protection circuit breaker and a residual-current-operated component is disclosed. Such a method comprises providing a first switching mechanism in the residual-current-operated component with a first switching toggle for operation of a first latching mechanism, which is accommodated in the residual-current-operated component and has at least one first latching point; providing a second switching mechanism in the line-protection circuit breaker with a second switching toggle for operation of a second latching mechanism, which is accommodated in the line-protection circuit breaker and has at least one second latching point; coupling the first and the second latching mechanisms using a first coupling element such that, when the first latching point is unlatched, the second latching point is also unlatched and in the process at least one contact point of the line-protection circuit breaker is opened, and that the second latching mechanism can be reconnected by means of the second switching toggle only when the first switching toggle has been pivoted through a predeterminable lead angle from its disconnected position in the direction of its connected position; and coupling the first and the second switching toggle using a second coupling element, wherein the second coupling element acts on the first switching toggle with respect to the second switching toggle, pivoting through the predeterminable lead angle in the direction of its connected position.

BRIEF DESCRIPTION OF THE DRAWINGS

The disclosure as well as further advantageous refinements and improvements of the disclosure will be explained and described in more detail with reference to the drawings, which illustrate six exemplary embodiments of the disclosure, and in which.

Components, elements or assemblies which are the same or have the same effect are each annotated with the same reference numbers in FIGS. 1 to 5.

DETAILED DESCRIPTION

Figure 1A:
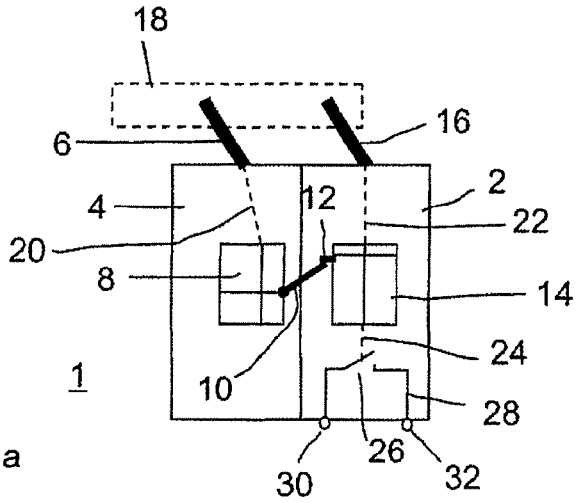
FIG. 1 shows a first exemplary embodiment of a full-protection circuit breaker according to the disclosure as a physical/functional combination of a single-pole-disconnecting line-protection circuit breaker with a residual-current-operated component, illustrated schematically.

Thus, according to the disclosure, the first switching toggle of the residual-current-operated component and the second switching toggle of the line-protection circuit breaker are coupled by means of a second coupling element, wherein the second coupling element acts on the first switching toggle with respect to the second switching toggle, pivoting through the predeterminable lead angle in the direction of its connected position.

An exemplary embodiment is provided by a full-protection circuit breaker of this generic type in which the first latching mechanism can be coupled by means of a first coupling element to a tripping lever of the second latching mechanism such that, when the first latching mechanism of the residual-current-operated component changes to its unlatching state and the first switching toggle pivots to its disconnected position, a latching point on the second latching mechanism is held in its unlatching position via the first coupling element and the tripping lever. This exemplary embodiment is also characterized in that, in the event of a forced movement from a first position, which corresponds to the disconnected position of the second switching toggle, to a second position, which corresponds to the connected position of the second switching toggle, the second component first of all acts only on the first switching toggle of the residual-current-operated component, pivoting it, and thus pivots the latter through a predeterminable lead angle before it also acts on the second switching toggle of the line-protection circuit breaker, pivoting it.

A further exemplary embodiment is characterized in that the first switching toggle is pivoted by the second coupling element at least through the lead angle with respect to the second switching toggle from its disconnected position and in the direction of its connected position, and is held.

In this case, in one exemplary embodiment, the lead angle is of such a size that the leading pivoting of the first switching toggle causes the first latching mechanism of the residual-current-operated component to adopt a state in which this latching mechanism releases the tripping lever of the line-protection circuit breaker via the first coupling element, and the latching point of the second latching mechanism can thus be latched again. Overall, this therefore allows joint connection of the residual-current-operated component and the line-protection circuit breaker by operation of a single control element.

In particular, a full-protection circuit breaker according to the disclosure can be positively reconnected by remote control via a motor connected to it. Positive reconnection of a line-protection circuit breaker via a switching motor connected to it is admittedly known in principle. However, without the configuration of a full-protection circuit breaker according to the disclosure, a motor connected for remote operation could, via its motor arm, drive only either the line-protection circuit breaker or only the residual-current-operated component, for reconnection. As described above, it would not be possible to connect the line-protection circuit breaker without previously having connected the residual-current-operated component. It would be just as impossible to connect the line-protection circuit breaker at the same time after connection of the residual-current-operated component because, in the case of the devices known from the prior art, this would require specific operation of the switching toggle of the line-protection circuit breaker. The teaching according to the disclosure for the first time allows joint connection of the residual-current-operated component and of the line-protection circuit breaker by a single control element, allowing a full-protection circuit breaker such as this according to the disclosure to be jointly and positively reconnected under remote control by means of a motor connected thereto.

FIG. 1 will be considered first of all. This shows, schematically, a full-protection circuit breaker 1 according to the disclosure which is composed of a physical/functional combination of a single-pole-disconnecting line-protection circuit breaker 2 with a residual-current-operated component 4, wherein the switch elements 2, 4 to be combined are each of slimline design, with the same housing contour. In principle, the residual-current-operated component 4 is a residual-current-operated circuit breaker without a contact point and without any connecting conductors. However, it also comprises the tripping and switching mechanism in the same way as any residual-current-operated circuit breaker which is used as a single switch element. In particular, it therefore has a first latching mechanism 8 which can be connected and disconnected manually from the outside via a first switching toggle 6 which interacts with the first latching mechanism 8 along a line of action 20. In the schematic example shown here, the latching mechanism 8 is intended to functionally comprise not only the mechanical parts such as the latching point and the lever mechanism but also the tripping mechanism which, for example, in a known manner contains a transformer with a secondary winding and a magnetic release, which interacts therewith, based on the clapper-type armature or the impact-type armature principle. The switching mechanism and tripping mechanism of the residual-current-operated component 4 and of the line-protection circuit breaker 2 will not be described any further in detail here since they are known in principle.

When a fault current occurs, the residual-current-operated component 4 can therefore not on its own interrupt the circuit to be monitored.

In fact, the line-protection circuit breaker 2 is used to interrupt the circuit, the latching mechanism 14 of which line-protection circuit breaker 2 opens or closes the contact point 26 in a current path 28 via a line of action 24, with the current path 28 being connected into the circuit to be monitored, between an input terminal 30 and an output terminal 32. The latching mechanism 14 of the line-protection circuit breaker can be operated manually from the outside via a second switching toggle 16, and then interacts with the latching mechanism 14 along a line of action 22. In the schematic illustration shown in FIG. 1, the thermal and/or magnetic release or releases which is or are normally provided in line-protection circuit breakers can also be considered to be functionally incorporated in the latching mechanism 14. Its configuration will not be described in any more detail for the purposes of the present disclosure, since this is known in principle.

The second latching mechanism 14 in the line-protection circuit breaker 2 comprises a tripping lever 12. If this is held in its release position, it prevents latching of the latching point which is likewise provided in the second latching mechanism 14 (this is not shown explicitly here), as a consequence of which the second latching mechanism 14 cannot be connected via the second switching toggle 16.

The first latching mechanism 8 of the residual-current-operated component 2 is coupled to the tripping lever 12 via a first coupling element 10. The first coupling element 10 may be a slide or a lever which passes through the joint broad faces of the line-protection circuit breaker 2 and of the residual-current-operated component 4 at a point that is intended for this purpose, and through openings which are provided for this purpose in the broad faces.

The two switching toggles 6, 16 of the residual-current-operated component 4 or of the residual-current-operated circuit breaker 2 are mechanically coupled to one another via a second coupling element 18.

The two switching toggles 6, 16 are located in their respective disconnected position in the illustration shown in FIG. 1*a*. The first latching mechanism 8 of the residual-current-operated component 4 is in its unlatching state. The latching mechanism means that the first coupling element 10 is held in a position such that said coupling element holds the tripping lever 12 in a position in which said tripping lever holds the latching point of the second latching mechanism 14 in its unlatching position. The second coupling element 14 is in a first position, which is also referred to in the following text as the disconnected position.

Figure 1B:
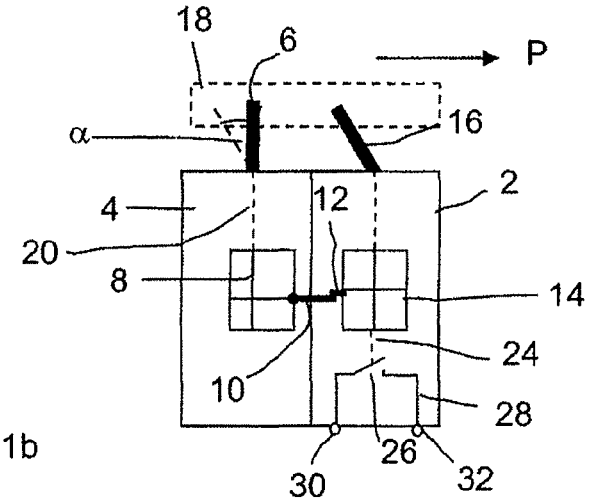
Figure 1C:
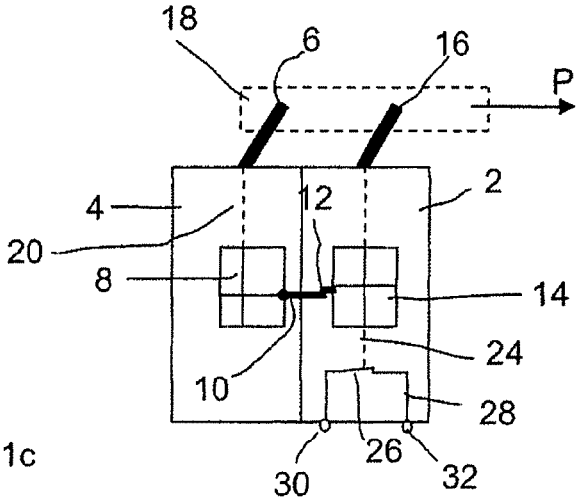

In the illustration shown in FIG. 1*c*, the two switching toggles 6, 16 are in their respective connected position. The first latching mechanism 8 has thus adopted a state in which it holds the first coupling element 10 in a released position such that the first coupling element 10 has released the tripping lever 12 of the line-protection circuit breaker 2 such that it has in consequence been possible to latch the latching point at the second latching mechanism 14 and the second latching mechanism 14 has been moved to its connected position by operation of the second switching toggle 16. In the connected state, the second latching mechanism 14 closes the contact point 26 in the current path 28 along the line of action 24. In this case, the second coupling element 18 is in a second position, which is also referred to in the following text as the connected position.

In the illustration shown in FIG. 1*b*, the second coupling element 18 has been moved somewhat in the direction of the arrow P to the right towards its connected position. It is in an intermediate position between the connected position and the disconnected position. The coupling between the second coupling element 18 and the two switching toggles 6,16 is designed such that, during the forced movement, part of which is shown in FIG. 1*b*, of the second coupling element 18 to the intermediate position, the second switching toggle 16 of the residual-current-operated circuit breaker 2 remains in its disconnected position. In contrast, the first switching toggle 6 of the residual-current-operated component 4 is acted on by the second coupling element, pivoting it in the direction of its connected position, and is moved in the direction of its connected position through a lead angle a. The lead angle a is sufficiently large to cause the first latching mechanism 8 to adopt a state in which it releases the tripping lever 12 via the first coupling element 10. The latching point of the second latching mechanism 14 can now be relatched. However, since the second switching toggle 16 of the line-protection circuit breaker 2 is still in its disconnected position, the second latching mechanism 14 has not yet been latched.

Depending on the specific mechanical design of the switching mechanisms and of the lever mechanisms, typical lead angle values are in the range between 9° and 40°.

When the second coupling element 18 moves further beyond the intermediate position to the connected position as shown in FIG. 1*c*, the second coupling element 18 then also pivots the second switching toggle 16 to its connected position.

Thus, overall, the forced movement of the second coupling element 18 from its disconnected position to its connected position allows joint connection of the line-protection circuit breaker 2 and of the residual-current-operated component 4 by movement of just a single coupling element. Without the coupling according to the disclosure of the two switching toggles 6,16 to the second coupling element 18, the first switching toggle 6 of the residual-current-operated component would first of all have had to be moved to its connected position, and only then would it have been possible to connect to the line-protection circuit breaker 2.

Figure 3A:
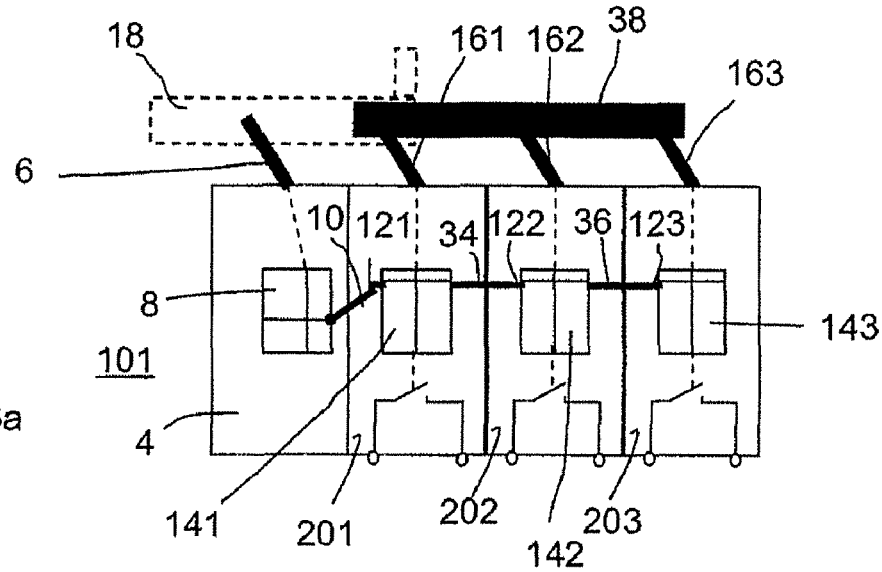
FIG. 3 shows a third exemplary embodiment of a full-protection circuit breaker according to the disclosure as a physical/functional combination of a three-pole-disconnecting arrangement of three single-pole-disconnecting line-protection circuit breakers with a residual-current-operated component, illustrated schematically.
Figure 3B:
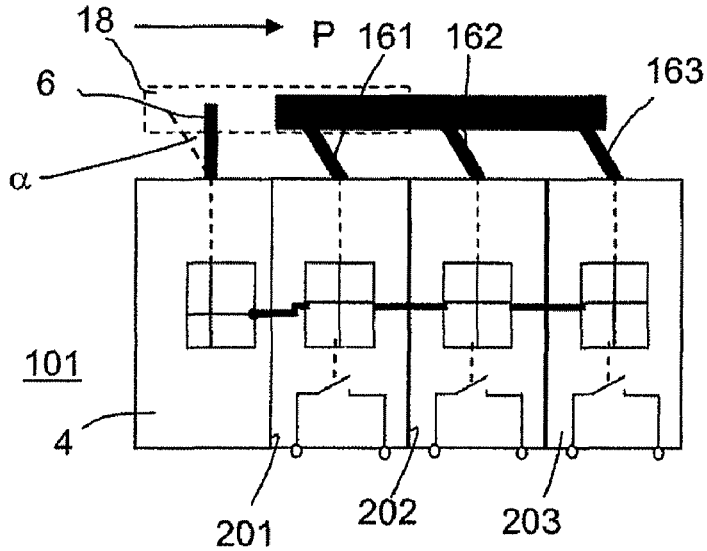
Figure 3C:
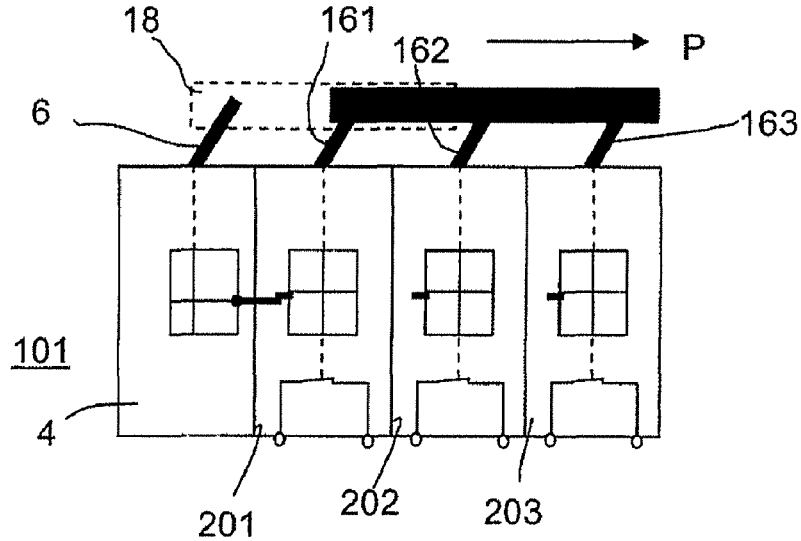

FIG. 3 will now be considered. The difference between the exemplary embodiment illustrated in FIG. 3 and the exemplary embodiment described above as shown in FIG. 1 is that, in FIG. 3, three line-protection circuit breakers 201, 202, 203 arranged in a row are provided instead of a single line-protection circuit breaker. Together, the three line-protection circuit breakers 201, 202, 203 form a three-pole-disconnecting line-protection circuit breaker block. The tripping lever 122 of the latching mechanism 142 in the central line-protection circuit breaker 202 is coupled via a coupling 34 to the latching mechanism 141 in the line-protection circuit breaker 201. The tripping lever 123 of the latching mechanism 143 in the line-protection circuit breaker 203 is likewise coupled via a coupling 36 to the latching mechanism 142 of the line-protection circuit breaker 202. The tripping lever 121 of the latching mechanism 141 of the line-protection circuit breaker 201 is coupled via a first coupling element 10 to the latching mechanism 8 of the residual-current-operated component 4. This ensures that, when the latching mechanism 141 of the line-protection circuit breaker 201, which rests directly on the residual-current-operated component 4, is positively tripped in the event of fault-current tripping of the latching mechanism 8 of the residual-current-operated component 4 via the first coupling element 10, the latching mechanisms 142 and 143 of the line-protection circuit breakers 202 and 203, which are arranged in a row with the line-protection circuit breaker 201, are also tripped at the same time. Each of the line-protection circuit breakers 201, 202 protects one pole current path. All three pole current paths are therefore disconnected in the event of positive tripping via the residual-current-operated component 4 when a fault current occurs.

In order to allow the three pole current paths also to be reconnected jointly, the three switching toggles 161,162,163 of the three line-protection circuit breakers 201, 202, 203 are connected to one another via a third coupling element 38. This connection of three single-pole line-protection circuit breakers, which are arranged in a row, in order to achieve three-pole protection is known in principle.

In order to arrive at a full-protection circuit breaker which provides a physical/functional combination of a three-pole-disconnecting assembly of three single-pole line-protection circuit breakers with a residual-current-operated component 4, the first switching toggle 6 of the residual-current-operated component 4 is coupled via a second coupling element 18 to the third coupling element 38, which connects the three switching toggles 161, 162, 163 to one another. The nature and functional configuration of this coupling is designed in a corresponding manner to that described above with reference to the exemplary embodiment shown in FIG. 1. Thus, when the second coupling element 18 is positively moved in the direction of the arrow P from its disconnected position, as shown in FIG. 3*a*, in the direction of its intermediate position, as shown in FIG. 3*b*, then the third coupling element 38 first of all remains in its position, and only the switching toggle 6 of the residual-current-operated component 4 is pivoted by the coupling element 18 through the lead angle a, as described above. Further linear movement of the coupling element 18 in the direction of the arrow P then also causes linear movement of the third coupling element 38, and thus pivoting of the three switching toggles 161, 162, 163, as a result of which the three pole current paths are reconnected.

Figure 4A:
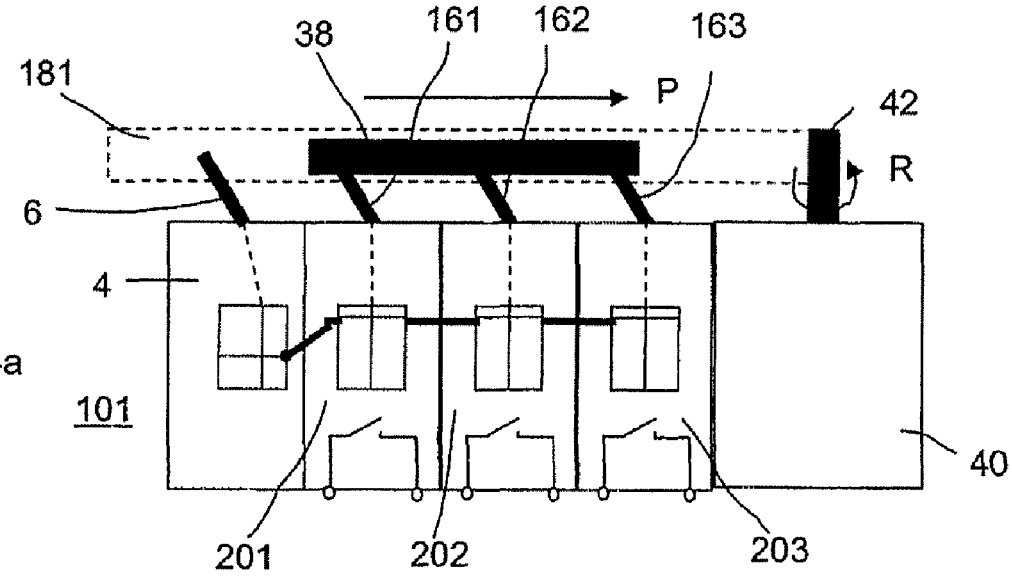
FIG. 4 shows a fourth exemplary embodiment of a full-protection circuit breaker according to the disclosure as a physical/functional combination of a three-pole-disconnecting arrangement of three single-pole-disconnecting line-protection circuit breakers with a residual-current-operated component and with a drive motor additionally connected for remotely controlled positive connection, illustrated schematically, with the lead being provided in the motor arm.
Figure 4B:
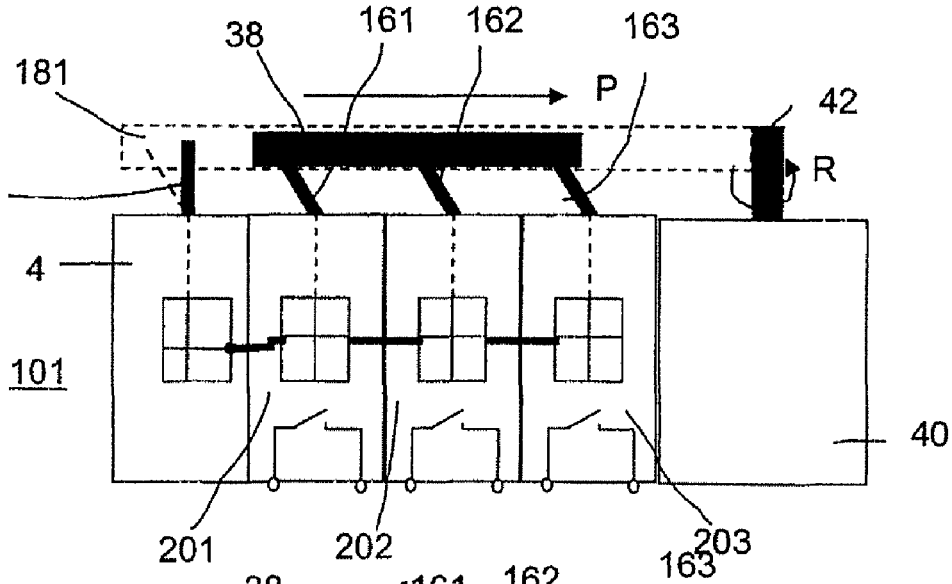
Figure 4C:
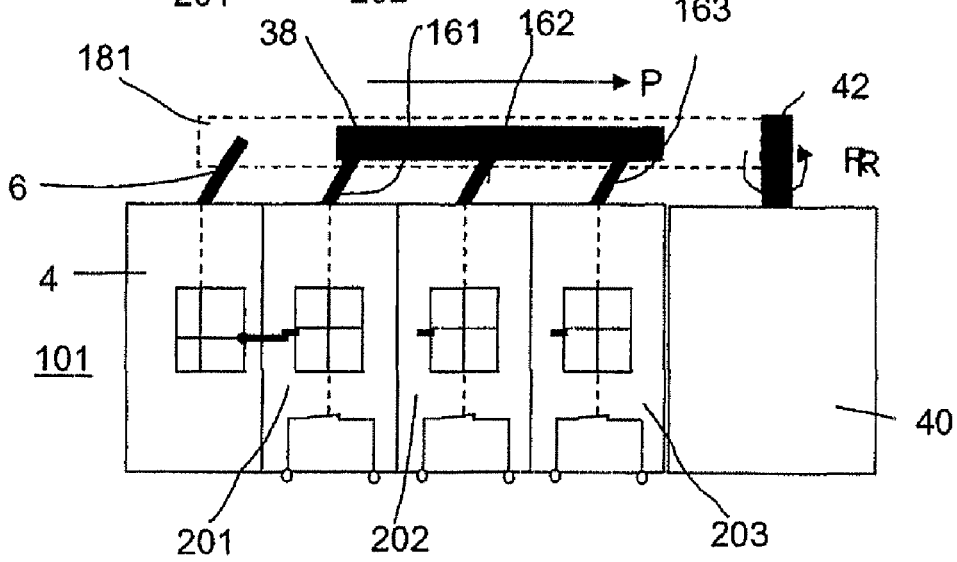

FIG. 4 will now be considered. In the exemplary embodiment shown here, a drive motor 40 is connected to the full-protection circuit breaker 101, as has been described in FIG. 3, and this drive motor 40 has a driven shaft 42. The motor 40 is used for remotely controlled reconnection of the full-protection circuit breaker 101. In this case, a second coupling element in the form of a motor arm 181 provides the coupling between the switching toggle 6 of the residual-current-operated component 4 and the third coupling element 38, which connects the switching toggles of the three single-pole-switching line-protection circuit breakers, which are arranged in a row, to one another. The motor arm 181 is coupled to the shaft 42. When the motor 40 receives the connection command by means of a remote-control signal, then the shaft 42 is driven and rotates in the direction of the rotary arrow 42. The motor arm 181 is therefore positively moved in the direction of the arrow P. The coupling of the motor arm 181 to the switching toggle 6 of the residual-current-operated component 4 and to the third coupling component 38 is functionally designed in precisely the same way as the coupling between the second coupling element 18 and the switching toggle 6, as well as the third coupling element 38, in the exemplary embodiment described in FIG. 3. Thus, when the motor is switched on, the switching toggle 6 is first of all pivoted through the lead angle a, such that the latching points in the three latching mechanisms of the three single-pole-switching line-protection circuit breakers, which are arranged in a row, can be latched again, and the third coupling element 38 is then moved further in the connection direction of the switching toggles of the line-protection circuit breakers. This allows joint connection of all three line-protection circuit breakers and of the residual-current-operated component via the motor arm of the remotely controllable switching motor 40.

Figure 5A:
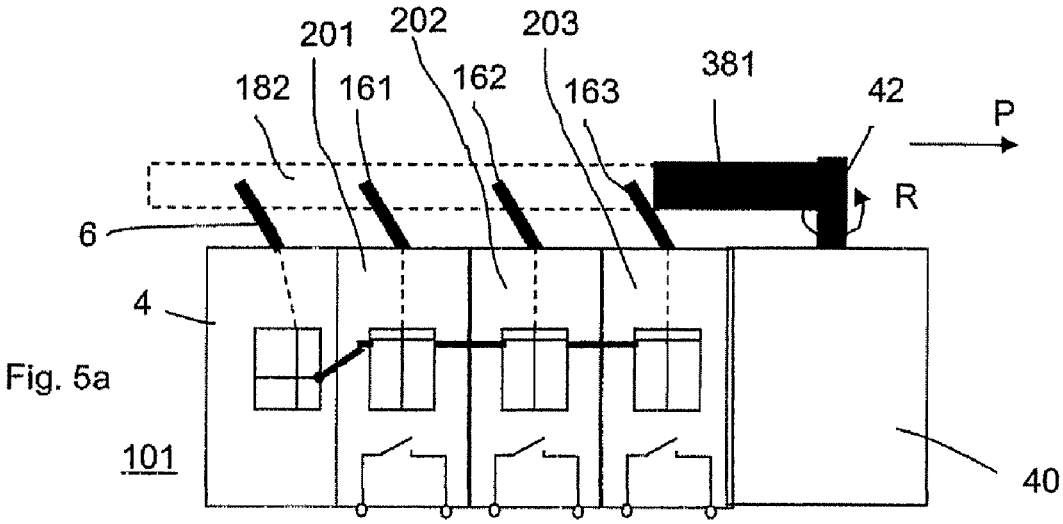
FIG. 5 shows a variant of the exemplary embodiment shown in FIG. 4, with the lead being provided in the connecting coupling.
Figure 5B:
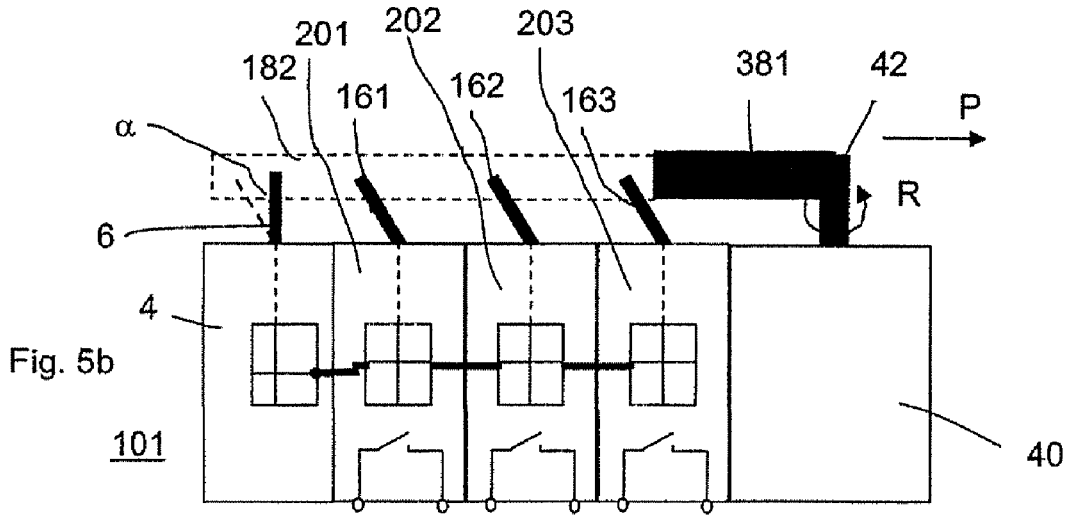
Figure 5C:
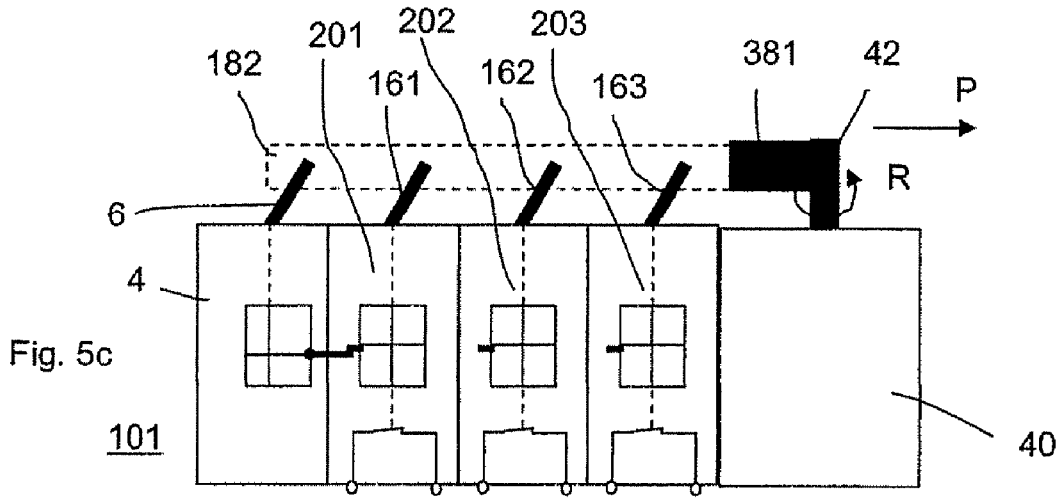

FIG. 5 will now be considered. In the exemplary embodiment shown here as well, a drive motor 40, which has a driven shaft 42, is connected to the full-protection circuit breaker 101, as has been described in FIG. 3. A second coupling element 182, which is in the form of a common coupling, is in this case used for the coupling between the first switching toggle 6 of the residual-current-operated component 4 and the second switching toggles 161, 162, 163 of the single-pole line-protection circuit breakers 201, 202, 203, which are arranged in a row to form a three-pole-disconnecting line-protection circuit breaker. The coupling, or the second coupling element of two at 80, is connected via a fourth coupling element 381 to the shaft 42 of the motor 40. The lead function is in this case provided in the common coupling 182. The figure element 5*a* shows, in a similar manner to that already described above with reference to FIGS. 1, 3 and 4, the disconnected position, while FIG. 5*c* shows the joint connected position, and FIG. 5*b* shows the intermediate position. In the intermediate position shown in FIG. 5*b*, the fourth coupling element 381, driven via the shaft 42 by the motor 40, has moved the common coupling 182 so far in the direction of the arrow P that the first switching toggle 6 has been pivoted through the lead angle $\alpha$, but second switching toggles 161, 162, 163 are still in their disconnected position. As the second coupling element 182 is positively moved further to its disconnected position as shown in FIG. 5*c*, the second switching toggles 161, 162, 163 are also pivoted by the second coupling element 182 to their connected position. Thus, in the exemplary embodiment shown in FIG. 5, the coupling function of the three switching toggles 161, 162, 163 of the line-protection circuit breakers is implemented with the lead function with respect to the first switching toggle 6 of the residual-current-operated component 4 in one common component, specifically in the common coupling 182.

The exemplary embodiments which have been described so far have always been based on the assumption that the first switching toggle 6 of the residual-current-operated component 4 is pivoted completely to its disconnected position when the residual-current-operated component 4 trips, with this disconnected position in each case corresponding to the situation illustrated in the drawing elements a of FIGS. 1, 3, 4 and 5. However, this is not absolutely essential. The procedure for assembly of a full-protection circuit breaker according to the disclosure could also be carried out in such a way that the fitting of the second coupling element 18 or of the motor arm 181 or the common coupling 182 results in the first switching toggle 6 of the residual-current-operated component 4 necessarily being moved to its intermediate position, or "lead position", as illustrated in the drawing elements b in FIGS. 1, 3, 4 or 5, and being held there. The joint connection of the residual-current-operated component 4 and of the line-protection circuit breakers would then take place from this position. The position illustrated in the drawing elements a of FIGS. 1, 3, 4, 5 would no longer be reached after the fitting of the full-protection circuit breaker. From this time, the lead angle $\alpha$ is then always set in the residual-current-operated component 4, and the latching point in the line-protection circuit breakers can always still be latched after this time. In the jointly connected state, which corresponds to the drawing elements C in FIGS. 1, 3, 4 or 5, there will be no change. On tripping of the residual-current-operated component 4, the first latching mechanism 4 in the residual-current-operated component 4 would unlatch and would thus move the first coupling element 10 to its disconnected position, in which it moves the tripping lever 12 of the line-protection circuit breaker, which is arranged in a row on the residual-current-operated component 4, to its release position. Only the first switching toggle 6 of the residual-current-operated component 4 would not be able to fall back to its disconnected position, but would remain in the intermediate position or "lead position". After tripping, the first latching mechanism 8 of the residual-current-operated component 4 would then return directly to the latched state, and the first coupling element 10 would directly adopt the state in which it releases the tripping lever 12 of the line-protection circuit breaker such that said line-protection circuit breaker can return directly to its latchable position again. The second latching mechanism 14 of the line-protection circuit breaker 2 would then be ready for reconnection via the second switching toggle 16 immediately after tripping. This variant requires only minor design changes to the second coupling element 18, the motor arm 181 or the common coupling 182. However, this simplifies the joint connection via the connected switching motor 40 since the pivoting, which was previously still required, of the first switching toggle 6 of the residual-current-operated component 4 through the lead angle $\alpha$ is now superfluous. This is possible in all the variants described here for construction of a full-protection circuit breaker according to the disclosure.

So far, the residual-current-operated component 4 has been described as a component which acts in the same way as a residual-current-operated circuit breaker, although it does not have the capabilities to directly interrupt a current path, that is to say it does not have a contact point with the corresponding connecting conductors, the fixed and moving contact pieces and the contact levers. A component which can be used as an autonomous residual-current-operated circuit breaker and which would then also have its own capabilities for current-path interruption could, however, of course also be used as a residual-current-operated component in a full-protection circuit breaker according to the disclosure.

FIG. 2 will now be considered. This shows a plan view of the broad face 80 of a further exemplary embodiment of a full-protection circuit breaker 102 according to the disclosure. The full-protection circuit breaker 102 comprises a residual-current-operated component 84 and a line-protection circuit breaker block arranged in a row with it. The line-protection circuit breaker block and the residual-current-operated component 84 have housings with approximately the same housing contour. This comprises front and rear faces 81, 82, 83, front and rear narrow faces 85, 86, a mounting face 87 and broad faces 80. The mounting face 87 is provided for mounting the full-protection circuit breaker 102 on a mounting rail of a service distribution panel. There, the full-protection circuit breaker 102 may possibly be arranged in a row with other service switching devices or else auxiliary devices such as a switching motor for connection. The devices are arranged in a row on their broad faces. Since the housing contours of the devices are largely coincident, only the broad face of the residual-current-operated component 84 can be seen in the view shown in FIG. 2. The line-protection circuit breaker is located, at right angles to the plane of the drawing, behind the residual-current-operated component 84, and is virtually completely covered by the residual-current-operated component 84.

Figure 2A:
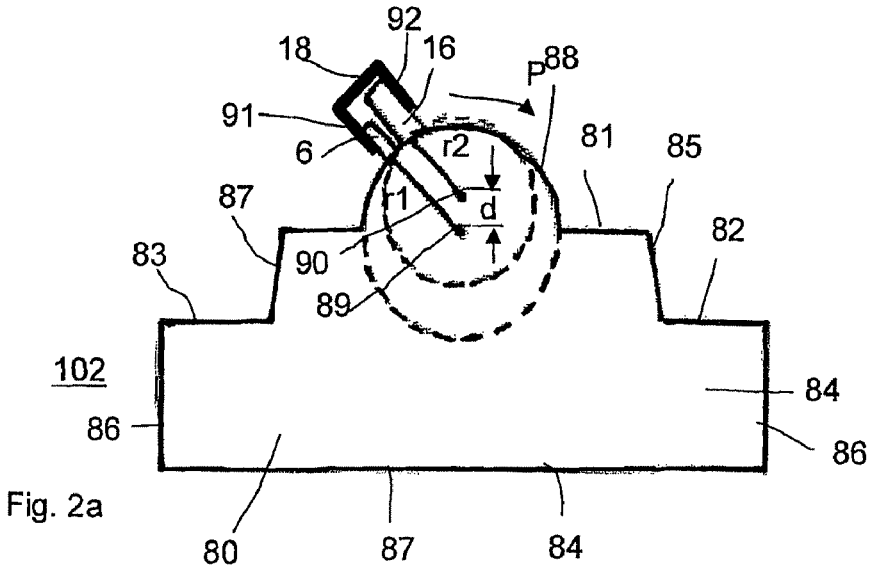
FIG. 2 shows a plan view of the broad face of a second exemplary embodiment of a full-protection circuit breaker according to the disclosure.

A dome-like bulge 88 is located on the front face 81 of the residual-current-operated component 84 and also of the line-protection circuit breaker located behind it, which bulge 88 surrounds parts of the mechanical latching mechanism and along whose curved outer surface the first switching toggle 6 of the residual-current-operated component and the second switching toggle of the line-protection circuit breaker can be pivoted. In the disconnected position, which is illustrated in FIG. 2*a*, the first switching toggle 6 of the residual-current-operated component is located in a position offset with respect to the second switching toggle 16 of the line-protection circuit breaker such that, in the plan view of the broad face 80, the second switching toggle 16 can be seen behind the residual-current-operated component 84. The two switching toggles 6, 16 have different rotation points 89, 90. The two rotation points 89, 90 lie on a line at right angles to the mounting face 87, at a distance d. The rotation point 89 of the first switching toggle 6 of the residual-current-operated component 84 is in this case located underneath the rotation point 90 of the second switching toggle 16 of the residual-current-operated circuit breaker, seen from the direction of the front face 81. The movement path of the first switching lever 6 of the residual-current-operated component 84 in this case follows a circular arc around the rotation point 89, which arc has a larger radius r1 than the movement path of the second switching toggle 16 of the line-protection circuit breaker, which follows a circular arc around the rotation point 90 and has a radius r2 which is less than the radius r1. The position of the two rotation points 89, 90 and the radii r1 and r2 are chosen such that, in the movement range of the two switching toggles 6, 16 along the curved surface of the dome-like bulge 88 between the disconnected position (see FIG. 2*a*) and the connected position (see FIG. 2*c*), the movement paths of the two switching toggles 6, 16 lie approximately on the curved surface of the dome-like bulge 88.

Figure 2B:
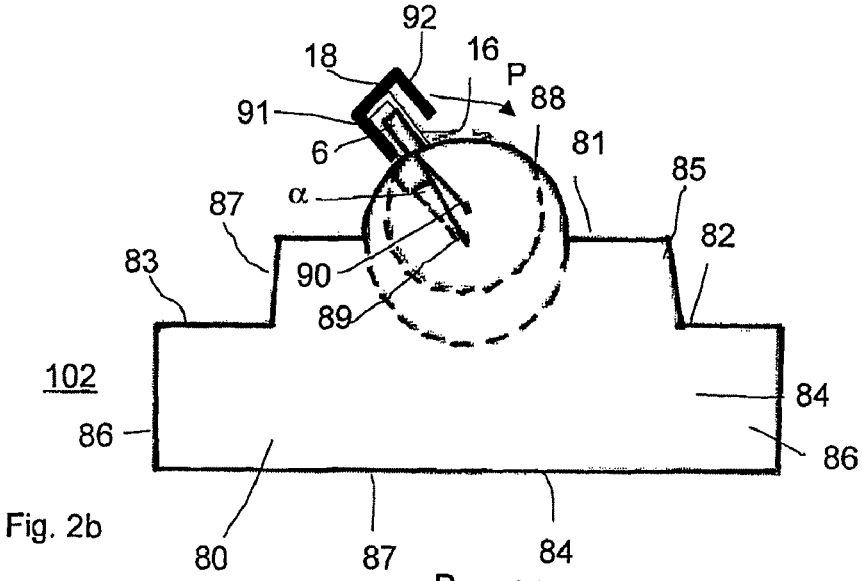
Figure 2C:
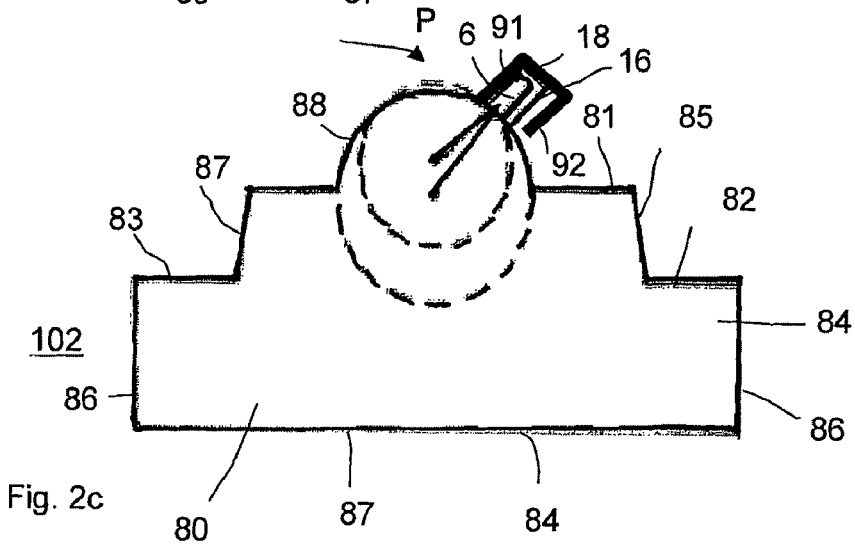

The two switching toggles 6, 16 are coupled to a second coupling element 18. The coupling element 18 is approximately in the form of a rail with a U-shaped profile. In the disconnected position as shown in FIG. 2*a*, one limb of the coupling element 18 in each case rests on one of the two switching toggles 6, 16. The coupling between the second switching toggle 16 of the line-protection circuit breaker and that limb 92 of the coupling element 18 which rests on it is a loose coupling. When an external force in the direction of the arrow P is applied to the coupling element 18, pivoting it, then the coupling element 18 first of all, via its limb 91, pivots the first switching toggle 6 of the residual-current-operated component 84 through a lead angle α. When the lead angle a has been reached, then the first switching toggle 6 acts on the second switching toggle 16, and the limb 91 of the coupling element 18 acts on the second switching toggle 16 of the line-protection circuit breaker. This situation of a so-called intermediate position or lead position is illustrated in FIG. 2*b*. During further positive pivoting of the coupling element 18 in the direction of the arrow P, that is to say in the clockwise direction, beyond this position, the limb 91 of the coupling element 18 drives both the first and the second switching toggles 6, 16 until both have been pivoted to their connected position, which is illustrated in FIG. 2*c*. The size of the lead angle α can in this case be fixed by the distance d between the two rotation points 89, 90.

The exemplary embodiment variant illustrated in FIG. 2 functionally corresponds to that which has been illustrated in FIG. 1 or 3, and has been described.

By way of example, the switching shaft of a switching motor could also act on the coupling element 18 and could pivot the coupling element 18 in the clockwise direction. This would then correspond functionally to an exemplary embodiment as shown in FIG. 5.

Figure 6:
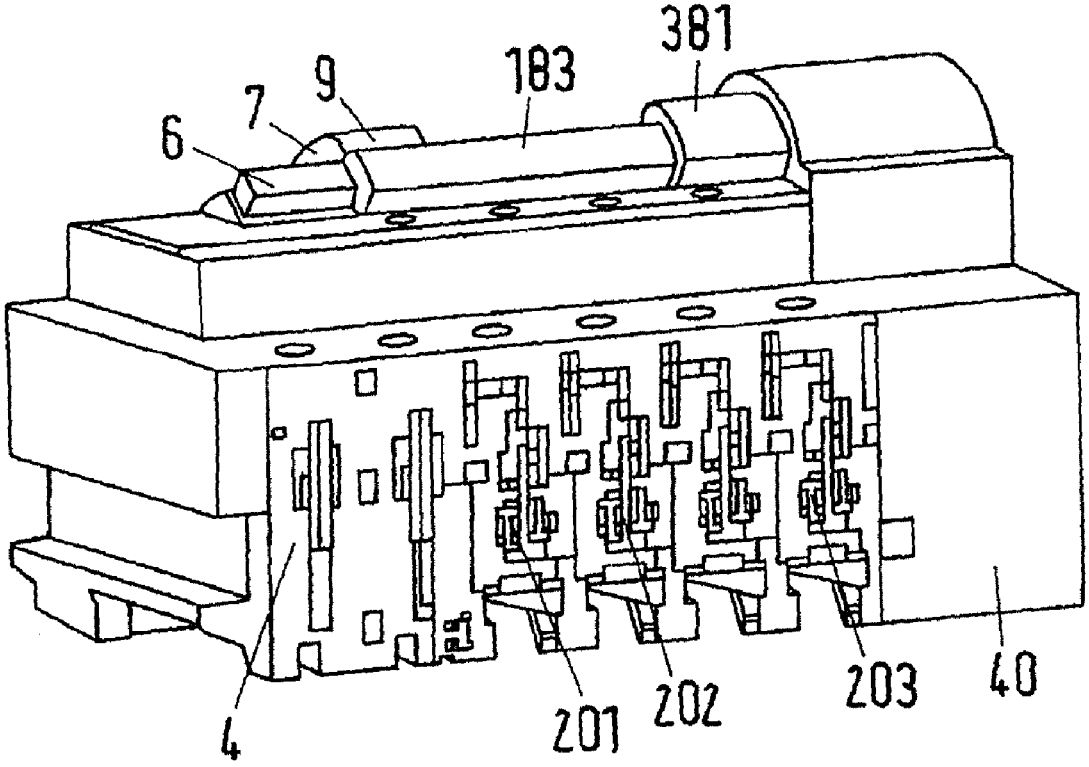
FIG. 6 shows a sixth exemplary embodiment of the disclosure.

FIG. 6 shows a further exemplary embodiment of the disclosure.

Three line-protection circuit breakers 201, 202, 203 are arranged in a row on their broad faces. Their switching toggles are connected by a circuit-breaker connector 183 to a joint connection and disconnection, and therefore cannot be seen in the illustration in FIG. 6.

A residual-current-operated component 4 is arranged on the outer left-hand broad face of the line-protection circuit breaker 201 and is functionally coupled to the line-protection circuit breakers 201, 202, 203, as described above. The residual-current-operated component 4 is in this context also referred to in the specialist language as a DDA. A switching motor 40 is arranged on the outer right-hand broad face of the line-protection circuit breaker 203. Its drive shaft is coupled to the circuit-breaker connector 183 by means of a fourth coupling element 381. In this case as is in principle generally normal practice nowadays, the line-protection circuit breakers 201, 202, 203 and the DDA 4 are connected and disconnected by pivoting the switching handles about their respective axis, as a result of which the switching handles cover an angle range on switching.

Figure 7:
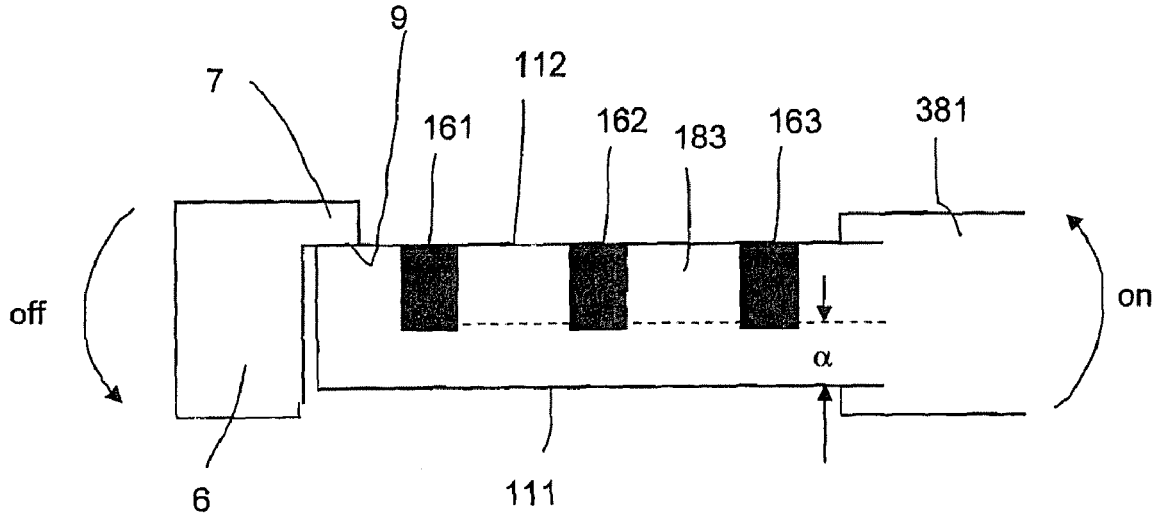
FIG. 7 shows a schematic plan view and view into the coupling as shown in FIG. 6.

The operation of the coupling according to the disclosure will be explained in the following text with reference to FIG. 7, which shows a schematic plan view and view into the coupling between the DDA, the line-protection circuit breakers and the motor.

In principle, the circuit-breaker connector 183 is an elongated rail, e.g., composed of plastic, which has an approximately U-shaped cross-sectional profile. In the installed position, which is illustrated in FIG. 6, the circuit-breaker connector 183 is pushed over the switching toggles 161, 162, 163 such that the opening in the U-profile points in the direction of the front face of the line-protection circuit breakers 201, 202, 203, and the lateral limbs 111, 112 of the U-profile surround the switching toggles 161,162,163. In this case, the first limb 112 rests on the switching toggles 161,162, 163 while, in contrast, a free space α a exists between the second limb 111 and the switching toggles. Functionally, to a certain extent, the limbs 112,111 represent stop edges for the switching toggles 161, 162, 163.

The first switching toggle 6 of the residual-current-operated component has a tab 7 which projects parallel to the profile of the circuit-breaker connector 183 and rests thereon at a coupling point 9. The first coupling element 381 is connected to the circuit-breaker connector 183.

When the switching motor 40 now pivots the fourth coupling element 381 in the direction of the arrow annotated "on", then this at the same time results in the circuit-breaker connector 183 being pivoted in the same direction. As a result of the coupling at the coupling point 9, the first switching toggle 6 of the DDA 4 is likewise pivoted in the connection direction. However, the switching toggles 161,162, 163 still remain in their disconnected position because the free space a means that the second limb 111 does not make contact with the switching toggles 161,162,163 until the circuit-breaker connector 183 has been pivoted through a linear distance or pivoting angle which corresponds to the free space a. The free space a therefore provides the lead which is required in order that the DDA can allow reconnection of the line-protection circuit breakers 201, 202, 203, as described above. This therefore allows joint connection of all three line-protection circuit breakers or poles 201, 202, 203 and of the DDA 4 by the switching motor.

In the connected state, the free space a nevertheless allows the switching toggles 161, 162, 163 to be pivoted to their disconnected position on tripping of a single line-protection circuit breaker or of all three line-protection circuit breakers or poles without tripping the DDA, for example as a result of a thermal overcurrent which would actually not trip the DDA. This is because, by virtue of the internal mechanical design of the line-protection circuit breakers 201, 202, 203, the latching point of the latching mechanism of a line-protection circuit breaker can be relatched after tripping only when the switching toggle is in its disconnected position. Only then is it possible to reconnect the line-protection circuit breaker. The coupling designed according to the disclosure allows entirely normal operation of the line-protection circuit breakers independently of the DDA, as well as positive tripping by the DDA with subsequent joint reconnection by means of the switching motor 40.

If, in contrast, the DDA responds as a result of a fault current and its first switching toggle 6 is pivoted to the disconnected position, identified by the arrow annotated "off", then the circuit-breaker connector 183 is pivoted immediately to the disconnected position as a result of the coupling at the coupling point 9, and with it, because the first limb 112 is resting on the switching toggles 161, 162, 163 these are also jointly moved immediately to their disconnected position.

The disclosure is, of course, not intended to be restricted to the exemplary embodiments illustrated schematically. All other design refinements which have the same functional purpose, that is to say specifically in the case of a coupling of the switching toggles of a residual-current-operated component arranged in a row and of a line-protection circuit breaker via a common coupling element with positive pivoting of the coupling element in which the first switching toggle of the residual-current-operated component is first of all pivoted through a specific lead angle before the second switching toggle of the line-protection circuit breaker is then likewise pivoted, are also covered by the present disclosure, at least in the equivalence area.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

| | | | |
|---|---|---|---|
| 1 | Full-protection circuit breaker | 183 | Circuit-breaker connector |
| 101 | Full-protection circuit breaker | 20 | Line of action |
| 102 | Full-protection circuit breaker | 22 | Line of action |
| 2 | Line-protection circuit breaker | 24 | Line of action |
| 201 | Line-protection circuit breaker | 26 | Contact point |
| 202 | Line-protection circuit breaker | 28 | Current path |
| 203 | Line-protection circuit breaker | 30 | Input terminal |
| 4 | Residual-current-operated component | 32 | Output terminal |
| 6 | First switching toggle | 34 | Coupling |
| 7 | Tab | 36 | Coupling |
| 8 | First latching mechanism in the residual-current-operated component | 38 | Third coupling element |
| 9 | Coupling point | 381 | Fourth coupling element |
| 10 | First coupling element | 40 | Motor |
| 111 | Limb, stop edge | 42 | Shaft |
| 112 | Limb, stop edge | 80 | Broad face |
| 12 | Tripping lever | 81 | Front face |
| 121 | Tripping lever | 82 | Rear face |
| 122 | Tripping lever | 83 | Rear face |
| 123 | Tripping lever | 84 | Residual-current-operated component |
| 14 | Second latching mechanism in the line-protection circuit breaker | 85 | Front narrow face |
| 141 | Latching mechanism | 86 | Rear narrow face |
| 142 | Latching mechanism | 87 | Mounting face |
| 143 | Latching mechanism | 88 | Dome-like bulge |
| 16 | Second switching toggle | 89 | Rotation point |
| 161 | Switching toggle | 90 | Rotation point |
| 162 | Switching toggle | 91 | Limb of the coupling element 18 |
| 163 | Switching toggle | 92 | Limb of the coupling element 18 |
| 18 | Second coupling element | | |
| 181 | Motor arm | P | Arrow |
| 182 | Joint coupling | R | Arrow |

What is claimed is:

1. A full-protection circuit breaker, comprising:

a line-protection circuit breaker and a residual-current-operated component which can be fitted thereto;

a first switching mechanism, which is provided in the residual-current-operated component, comprising a first switching toggle for operation of a first latching mechanism, which is accommodated in the residual-current-operated component and has at least one first latching point; and a second switching mechanism, which is provided in the line-protection circuit breaker, comprising a second switching toggle for operation of a second latching mechanism, which is accommodated in the line-protection circuit breaker and has at least one second latching point, wherein the first and the second latching mechanisms are coupled by means of a first coupling element such that, when the first latching point is unlatched, the second latching point is also unlatched and in the process at least one contact point of the line-protection circuit breaker is opened, and that the second latching mechanism is configured to be reconnected by means of the second switching toggle only when the first switching toggle has been pivoted through a predeterminable lead angle from its disconnected position in the direction of its connected position, wherein the first and the second switching toggle are coupled by means of a second coupling element, wherein the second coupling element acts on the first switching toggle with respect to the second switching toggle, pivoting through the predeterminable lead angle in the direction of its connected position, wherein the first latching mechanism is configured to be coupled by means of a first coupling element to a tripping lever of the second latching mechanism such that, when the first latching mechanism of the residual-current-operated component changes to its unlatching state and the first switching toggle pivots to its disconnected position, a latching point on the second latching mechanism is held in its unlatching position via the first coupling element and the tripping lever, and wherein, in the event of a forced movement from a first position, which corresponds to the disconnected position of the second switching toggle, to a second position, which corresponds to the connected position of the second switching toggle, the second component first of all acts only on the first switching toggle of the residual-current-operated component, pivoting the first switching toggle, and thus pivots the first switching toggle through a predeterminable lead angle before the second component also acts on the second switching toggle of the line-protection circuit breaker, pivoting the second switching toggle.

2. The full-protection circuit breaker according to claim 1, wherein the first switching toggle is pivoted by the second coupling element at least through the lead angle with respect to the second switching toggle from its disconnected position and in the direction of its connected position, and is held.

3. The full-protection circuit breaker according to claim 1, wherein the lead angle is of such a size that the leading pivoting of the first switching toggle causes the first latching mechanism to adopt a state in which the first latching mechanism releases the tripping lever via the first coupling element, and the latching point of the second latching mechanism is configured to be latched again, to thereby allow for a joint connection of the residual-current-operated component and the line-protection circuit breaker by operation of a single control element.

4. The full-protection circuit breaker according to claim 3, wherein the second coupling element is in the form of a profiled rail.

5. The full-protection circuit breaker according to claim 1, wherein the second coupling element is in the form of a profiled rail.

6. The full-protection circuit breaker according to claim 5, wherein the rotation points of the first and second switching toggles are at a distance from one another, and the rotation point of the first switching toggle is closer to the mounting face of the full-protection circuit breaker than the rotation point of the second switching toggle.

7. The full-protection circuit breaker according to claim 1, wherein the rotation points of the first and second switching toggles are at a distance from one another, and the rotation point of the first switching toggle is closer to the mounting face of the full-protection circuit breaker than the rotation point of the second switching toggle.

8. The full-protection circuit breaker according to claim 1, comprising:

three single-pole line-protection circuit breakers, which are arranged in a row to form a three-pole-switching line-protection circuit breaker block; and a residual-current-operated component which can be fitted thereto, wherein the three switching toggles of the line-protection circuit breakers are connected to one another by means of a third coupling element for joint connection, wherein the first switching toggle of the residual-current-operated component is coupled to the third coupling element by means of the second coupling element, and wherein the second coupling element acts on the first switching toggle with respect to the connected switching toggles, pivoting through the predeterminable lead angle in the direction of its connected position.

9. The full-protection circuit breaker according to claim 1, comprising:

three single-pole line-protection circuit breakers, which are arranged in a row to form a three-pole-switching line-protection circuit breaker block; and a residual-current-operated component which can be fitted thereto, wherein the first switching toggle of the residual-current-operated component is coupled by means of the second coupling element to the three switching toggles of the line-protection circuit breakers, and wherein the second coupling element acts on the first switching toggle with respect to the switching toggles, pivoting through the predeterminable lead angle in the direction of its connected position.

10. A motor-controllable full-protection circuit breaker comprising the full-protection circuit breaker according to claim 9, and a switching motor which is configured to be arranged in a row thereon and be remotely controlled, wherein the second coupling element is configured to be moved, in a forced manner, by the switching motor in the direction of a second position which corresponds to the connected position of the switching toggle of the line-protection circuit breaker.

11. A motor-controllable full-protection circuit breaker comprising the full-protection circuit breaker according to claim 1, and a switching motor which is configured to be arranged in a row thereon and be remotely controlled, wherein the second coupling element is configured to be moved, in a forced manner, by the switching motor in the direction of a second position which corresponds to the connected position of the switching toggle of the line-protection circuit breaker.

12. The motor-controllable full-protection circuit breaker according to claim 11, wherein the motor is directly coupled to the second coupling element.

13. The motor-controllable full-protection circuit breaker according to claim 11, wherein the motor is coupled to the second coupling element via a fourth coupling element.

14. A full-protection circuit breaker arrangement, comprising:

a line-protection circuit breaker;

a residual-current-operated component;

a first switching mechanism, which is provided in the residual-current-operated component, comprising a first switching toggle for operation of a first latching mechanism, which is accommodated in the residual-current-operated component and has at least one first latching point; and a second switching mechanism, which is provided in the line-protection circuit breaker, comprising a second switching toggle for operation of a second latching mechanism, which is accommodated in the line-protection circuit breaker and has at least one second latching point, wherein the first and the second latching mechanisms are coupled using a first coupling element, wherein the first and the second switching toggle are coupled using a second coupling element, wherein the second coupling element acts on the first switching toggle with respect to the second switching toggle, pivoting through the predeterminable lead angle in the direction of its connected position, wherein the first latching mechanism is configured to be coupled by means of a first coupling element to a tripping lever of the second latching mechanism such that, when the first latching mechanism of the residual-current-operated component changes to its unlatching state and the first switching toggle pivots to its disconnected position, a latching point on the second latching mechanism is held in its unlatching position via the first coupling element and the tripping lever, and wherein, in the event of a forced movement from a first position, which corresponds to the disconnected position of the second switching toggle, to a second position, which corresponds to the connected position of the second switching toggle, the second component first of all acts only on the first switching toggle of the residual-current-operated component, pivoting the first switching toggle, and thus pivots the first switching toggle through a predeterminable lead angle before the second component also acts on the second switching toggle of the line-protection circuit breaker, pivoting the second switching toggle.

15. A method of providing a full circuit-breaker protection based on a line-protection circuit breaker and a residual-current-operated component, the method comprising:

providing a first switching mechanism in the residual-current-operated component with a first switching toggle for operation of a first latching mechanism, which is accommodated in the residual-current-operated component and has at least one first latching point;

providing a second switching mechanism in the line-protection circuit breaker with a second switching toggle for operation of a second latching mechanism, which is accommodated in the line-protection circuit breaker and has at least one second latching point;

coupling the first and the second latching mechanisms using a first coupling element such that, when the first latching point is unlatched, the second latching point is also unlatched and in the process at least one contact point of the line-protection circuit breaker is opened, and that the second latching mechanism can be reconnected by means of the second switching toggle only when the first switching toggle has been pivoted through a predeterminable lead angle from its disconnected position in the direction of its connected position; and coupling the first and the second switching toggle using a second coupling element, wherein the second coupling element acts on the first switching toggle with respect to the second switching toggle, pivoting through the predeterminable lead angle in the direction of its connected position, wherein the first latching mechanism is configured to be coupled by means of a first coupling element to a tripping lever of the second latching mechanism such that, when the first latching mechanism of the residual-current-operated component changes to its unlatching state and the first switching toggle pivots to its disconnected position, a latching point on the second latching mechanism is held in its unlatching position via the first coupling element and the tripping lever, and wherein, in the event of a forced movement from a first position, which corresponds to the disconnected position of the second switching toggle, to a second position, which corresponds to the connected position of the second switching toggle, the second component first of all acts only on the first switching toggle of the residual-current-operated component, pivoting the first switching toggle, and thus pivots the first switching toggle through a predeterminable lead angle before the second component also acts on the second switching toggle of the line-protection circuit breaker, pivoting the second switching toggle.

* * * * *